United States Patent [19]

Yamaguchi

[11] Patent Number: 4,660,624

[45] Date of Patent: Apr. 28, 1987

[54] MOTORCYCLE RADIATOR

[75] Inventor: Ken Yamaguchi, Saitama, Japan

[73] Assignee: Honda Giken Kogyo Kabushiki Kaisha, Tokyo, Japan

[21] Appl. No.: 541,450

[22] Filed: Oct. 13, 1983

[30] Foreign Application Priority Data

Oct. 13, 1982 [JP] Japan ..... 57-154941[U]

[51] Int. Cl.[4] ..... F28F 1/00

[52] U.S. Cl. ..... 165/41; 180/68.4; 180/229

[58] Field of Search ..... 165/41, 125; 180/219, 180/229, 68.4

[56] References Cited

U.S. PATENT DOCUMENTS

| | | | |
|---|---|---|---|
| 2,261,579 | 11/1941 | Booth | 165/41 |
| 3,981,354 | 9/1976 | Haberski | 165/125 |
| 4,019,595 | 4/1977 | Smai et al. | 180/229 |
| 4,051,893 | 10/1977 | Guibert | 165/125 |
| 4,180,137 | 12/1979 | Wagner | 180/229 |
| 4,237,996 | 12/1980 | Matsuda et al. | 180/229 |
| 4,428,451 | 1/1984 | Yamaoka | 165/41 X |
| 4,461,366 | 7/1984 | Honda | 165/41 X |
| 4,465,125 | 8/1984 | Haas | 165/125 |

FOREIGN PATENT DOCUMENTS

| | | | |
|---|---|---|---|
| 21657 | 1/1981 | European Pat. Off. | 180/229 |
| 78123 | 6/1980 | Japan | 180/229 |
| 146987 | 11/1981 | Japan | 165/125 |
| 495096 | 1/1937 | United Kingdom | 165/41 |
| 506146 | 5/1939 | United Kingdom | 165/41 |
| 559309 | 2/1944 | United Kingdom | 165/41 |
| 572629 | 10/1945 | United Kingdom | 165/41 |
| 583814 | 12/1946 | United Kingdom | 165/41 |
| 709742 | 6/1954 | United Kingdom | 165/41 |

*Primary Examiner*—Albert W. Davis, Jr.
*Assistant Examiner*—Peggy Neils
*Attorney, Agent, or Firm*—Lyon & Lyon

[57] ABSTRACT

A radiator for a motorcycle having a core with an arcuate front surface. The radiator tanks remain parallel. The radiator is retained by means of a pin and fastener means nonconcentrically arranged to insure proper mounting under heavy load road conditions. The tubes of the core may be arranged in either vertical or horizontal extension and may be arcuate to define the concave front surface of the core. Straight tubes of varying width may also be employed to define the arcuate front surface.

8 Claims, 7 Drawing Figures

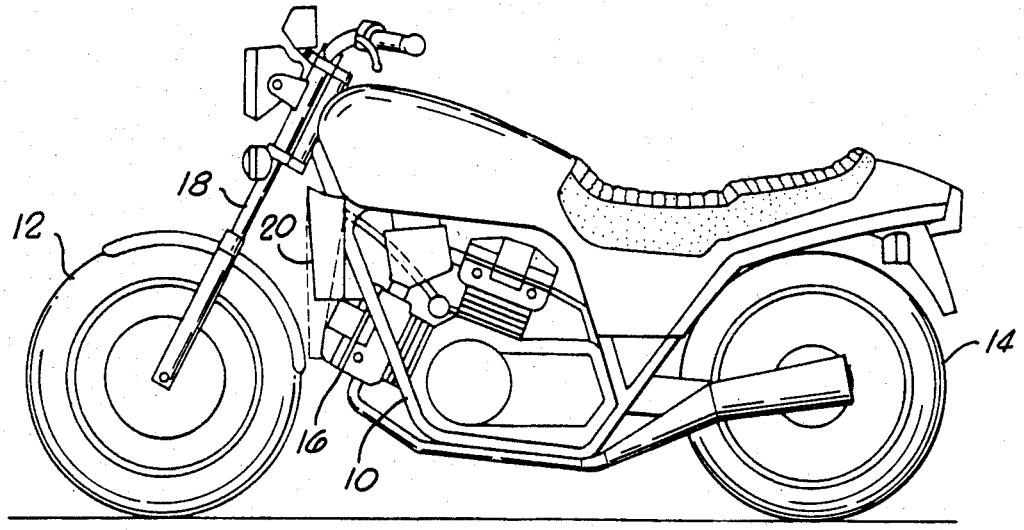
FIG. 1.
PRIOR ART
FIG. 2.
PRIOR ART
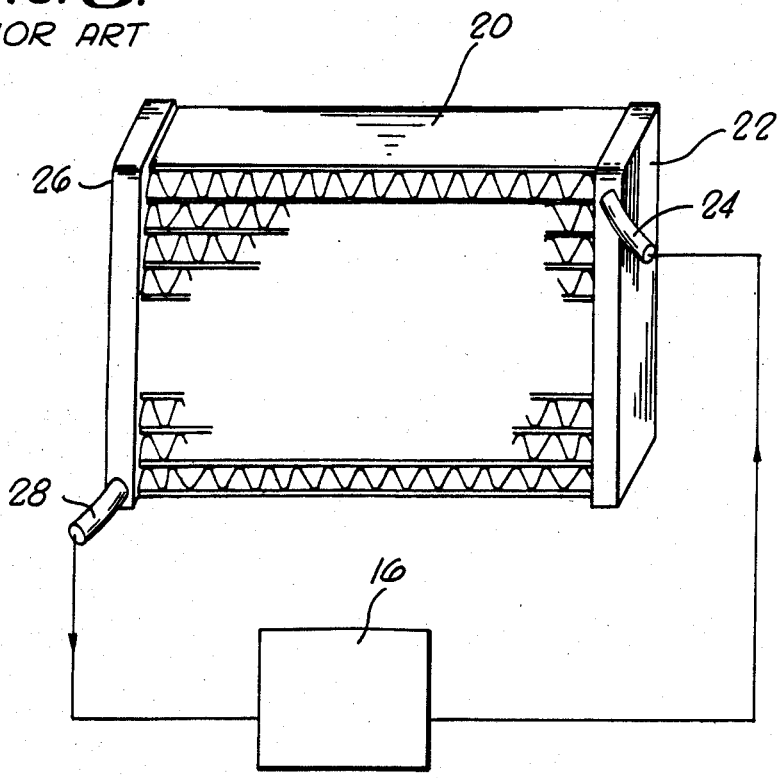

FIG. 5.
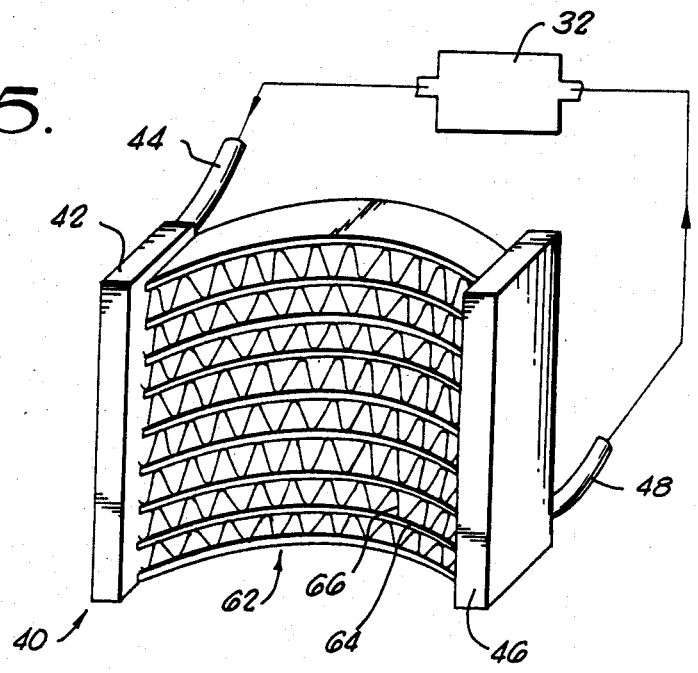
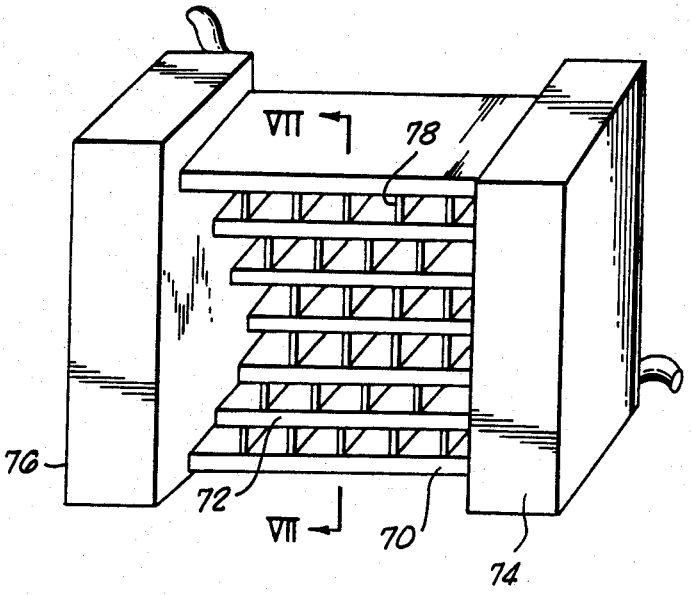
FIG. 6.
FIG. 7.
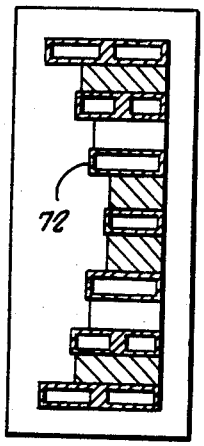

MOTORCYCLE RADIATOR

BACKGROUND OF THE INVENTION

The field of the present invention is radiators for motorcycles employed for the cooling of coolant or lubricant.

Recent motorcycle designs have emphasized water-cooled engines responsive to the need for greater engine efficiency and reduced air pollution. The use of water-cooled systems gives certain advantages but also can create detrimental results as well. Specifically, water-cooled systems tend to occupy more room than corresponding air-cooled systems. In motorcycle designs, where compactness is very important, the requirement for additional space is disadvantageous.

In the case of radiators for water-cooled systems, the radiators have been generally placed behind the front fork of the motorcycle and in front of the engine. This location is generally limited because of the normal stroke of the front fork assembly. To avoid interference between a radiator mounted in this location and the front fender or wheel, the motorcycle may be extended in length. This is undesirable and generally requires greater structure and weight. Additionally, the space problem becomes greater when a V-engine is employed with the front cylinder bank extending forwardly toward the front fork assembly. One such configuration is illustrated in FIGS. 1 and 2 of the drawings where it can be seen that additional space is required for location of the radiator. Furthermore, to employ a radiator of adequate capacity in the position behind the front fork assembly where air flow is disturbed, a larger radiator is desirable as illustrated in dotted line in FIG. 1.

SUMMARY OF THE INVENTION

The present invention is directed to a radiator for employment on motorcycles. The radiator is designed for maximum efficiency with minimum size. To accomplish this result, an arcuate front face is defined in the radiator core between inlet and outlet tanks. Greater tube surface area may be realized with such a configuration without increasing the extension of the overall vertical or horizontal size of the radiator. The inlet and outlet tanks may be generally parallel in spite of the arcuate nature of the radiator core in order to not increase resistance to air flow around the components of the motorcycle.

The advantageous arcuate front surface of the core of the radiator may be defined by arcuate core tubes or by straight tubes arranged in a staggered manner. The concave surface may also give added clearance from the front wheel when oriented such that the arcuate tubes extend horizontally in the core.

The radiator may also be mounted to the frame of the motorcycle for optimum and facile placement thereof. To this end, fastening elements associated with brackets extending forwardly from the frame to side plates on the radiator allow for fastening elements to interlock the brackets with the radiator. A pin which is mutually nonconcentric with the fastening elements interlocks between the radiator and the bracket to prevent rotation of the radiator under the high-load riding conditions.

Accordingly, it is an object of the present invention to provide an improved radiator and radiator mounting arrangement for motorcycles. Other and further objects and advantages will appear hereinafter.

BRIEF DESCRIPTION OF THE DRAWINGS

FIG. 1 is a cross-sectional elevation of a motorcycle illustrating a radiator of the prior art.

FIG. 2 is an oblique view of a radiator of the prior art.

FIG. 5 is an oblique view of an alternate embodiment of the radiator of the present invention.

FIG. 6 is an oblique view of yet another embodiment of a radiator of the present invention.

FIG. 7 is a cross-sectional side view taken along line 7-7 of FIG. 6.

DETAILED DESCRIPTION OF THE PREFERRED EMBODIMENTS

Figure 3:
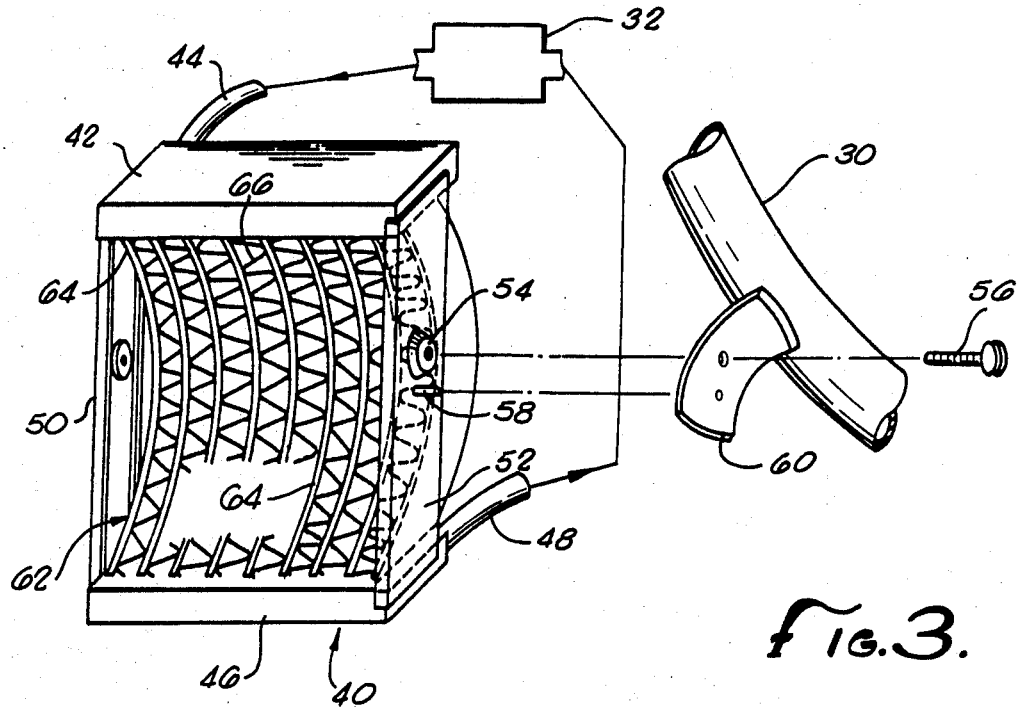
FIG. 3 is an oblique view of a radiator of the present invention.

Turning in detail to the drawings, a conventional motorcycle arrangement is illustrated in FIG. 1 with a conventional radiator illustrated in FIG. 2. The motorcycle includes a frame 10, a front wheel 12 and rear wheel 14. An engine 16 is positioned on the frame and the front wheel 12 is suspended on the frame 10 by means of a front fork assembly 18. A conventional radiator 20 is illustrated in front of the engine 16, associated with the frame 10 and rearwardly of the front fork assembly 18. Illustrated in dotted line is a preferred extension of a radiator for efficient engine coolant. However, such an extended radiator would interfere with the stroke of the front fork assembly.

The radiator illustrated in FIG. 2 which may be employed in the assembly of FIG. 1 includes a central core 20 extending between parallel tanks. An inlet tank 22 receives flow from the engine 16 to an inlet 24. The outlet tank 26 directs flow to an outlet 28 which directs cooled liquid to the engine. A corrugated pin structure is positioned between radiator tubes.

Figure 4:
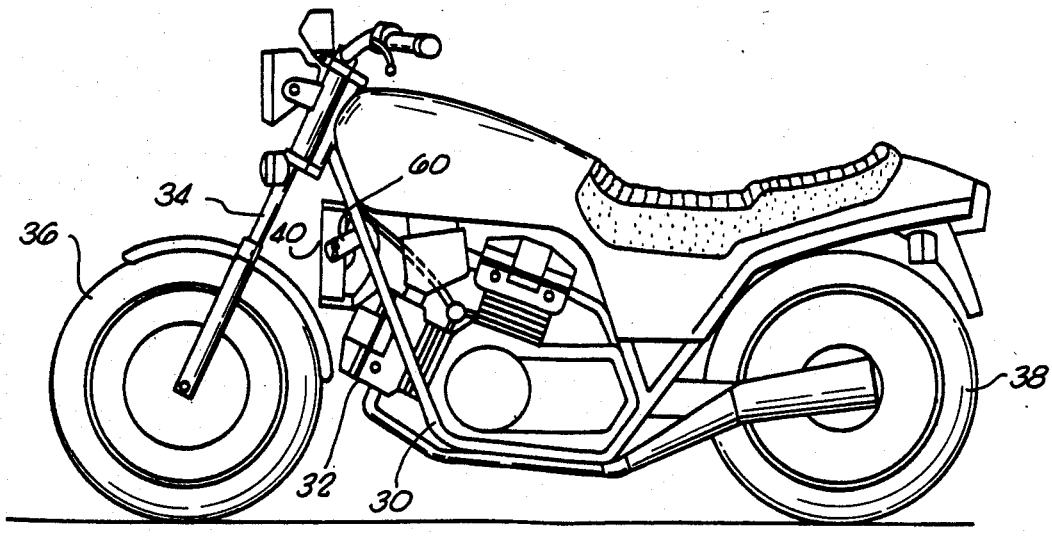
FIG. 4 is a side elevation of a motorcycle incorporating the radiator of FIG. 3.

A motorcycle incorporating the present invention is illustrated in FIG. 4 as including a frame 30, an engine 32 positioned in the frame 30, a front fork assembly 34 supporting a front wheel 36 and a rear wheel 38. A radiator 40 is illustrated as being mounted to the frame 30 between the engine 32 and the front fork assembly 34. This radiator 40 is better illustrated in FIG. 3.

The radiator 40 includes an inlet tank 42 into which coolant is directed from the engine 32 through an inlet 44. An outlet tank 46 includes an outlet 48 for directing cooled liquid to the engine 32. The tanks 42 and 46 are generally rectangular in cross section and are arranged in parallel relationship. The parallel relationship of these tanks reduces air flow resistance of the radiator.

Extending between the inlet tank 42 and the outlet tank 46 are side mounting plates 50 and 52. The side mounting plates 50 and 52 are generally parallel and may include flanged edges for added structural rigidity as can be seen in FIG. 3. A fastening element 54 is associated with each plate 50 and 52. The element may include a fixed nut into which a fastener 56 may be threaded. A pin 58 extends outwardly from the plate 52. A bracket 60 fastened to the frame 30 extends forwardly to receive the pin 58 and to be positioned over the fastening element 54 such that the fastener 56 may be threaded into the captive nut.

The core 62 of the radiator 40 includes a concave front surface. This concave front surface is defined by parallel tubes 64 extending between the tanks 42 and 46. In the embodiment illustrated in FIG. 3, the arcuate tubes extend vertically and include corrugated cooling fins 66 therebetween. The construction of the tube 64 increases the surface area of the core 62 which is available for cooling. In this way, reduced interference with the motorcycle front fork is achieved with increased radiator efficiency. FIG. 5 illustrates a similar radiator configuration employing corresponding numbers. However, the radiator is oriented with the tubes 64 extending in a horizontal direction. This provides an arcuate arrangement which avoids the stroke of the front fork to a greater extent. The tanks 42 and 46 remain parallel to the air flow while the arcuate tubes 64 add to the cooling surface area of the core 62.

Finally, the embodiment of FIGS. 6 and 7 illustrate the use of a radiator core 70 employing straight tubes 72 extending between tanks 74 and 76. The tubes 72 are shown to be of varying width. Furthermore, the tubes 72 are stacked one in front of the other at the outer extremeties of the radiator. Reference is specifically made to FIG. 7 in that regard. Fins 78 add to the structure of the radiator and provide increased cooling surface for heat flow from the radiator surface.

Accordingly, an improved radiator configuration is disclosed incorporating a concave front surface. Increased tube area without a corresponding increase in overall radiator size provides more efficient cooling without interference with other motorcycle components such as the front fork and wheel assembly. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A motorcycle comprising a frame, a front fork mounted on said frame for supporting a front wheel, an engine positioned on said frame behind said front fork, and a radiator mounted to said frame between said front fork and said engine, said radiator having a concave front surface oriented towards said front fork.

2. A motorcycle comprising a frame, a front fork mounted on said frame for supporting a front wheel, an engine positioned on said frame behind said front fork, and a radiator mounted to said frame between said front fork and said engine, said radiator having a concave front surface oriented towards said front fork, said radiator having an inlet tank, an outlet tank and a radiator core extending between said inlet tank and said outlet tank, said inlet and said outlet tanks of said radiator being generally rectangular in cross section, the sides of said tanks being mutually parallel.

3. A motorcycle comprising a frame having two laterally spaced down tubes, a front fork mounted on said frame for supporting a front wheel forwardly of said down tubes, an engine positioned on said frame behind said front fork, and a radiator mounted to said frame between said front fork and said engine and between said two down tubes, said radiator having a concave front surface oriented toward said front fork, said radiator having an inlet tank, an outlet tank and a radiator core extending between said inlet tank and said outlet tank, said inlet and said outlet tanks of said radiator are generally rectangular in cross section, the sides of said tanks being mutually parallel and said radiator having a convex rear surface oriented toward said engine.

4. The motorcycle of claim 1 wherein said radiator core includes tubes, said tubes being arcuate to define said concavity.

5. The motorcycle of claim 4 wherein said arcuate tubes of said radiator extend horizontally relative to the motorcycle.

6. The motorcycle of claim 4 wherein said arcuate tubes of said radiator extend vertically relative to the motorcycle.

7. The motorcycle of claim 4 wherein said radiator core further includes corrugated fins extending between said tubes.

8. The motorcycle of claim 2 wherein said radiator core includes a plurality of parallel tubes extending and in communication between said inlet tank and said outlet tank, each of said tubes extending in a straight line with said plurality of tubes defining said concavity.

* * * * *